US007521820B2

(12) United States Patent
Kitamura

(10) Patent No.: US 7,521,820 B2
(45) Date of Patent: Apr. 21, 2009

(54) ELECTRICAL APPARATUS SYSTEM

(75) Inventor: Hiroyasu Kitamura, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 305 days.

(21) Appl. No.: 11/456,959

(22) Filed: Jul. 12, 2006

(65) Prior Publication Data

US 2007/0013343 A1 Jan. 18, 2007

(30) Foreign Application Priority Data

Jul. 15, 2005 (JP) ..... 2005-207575

(51) Int. Cl.
*H02J 3/38* (2006.01)

(52) U.S. Cl. ..... 307/19

(58) Field of Classification Search ..... 307/19
See application file for complete search history.

(56) References Cited

U.S. PATENT DOCUMENTS 5,711,328 A 1/1998 Braun
6,078,109 A * 6/2000 Yanagisawa ..... 307/18
2003/0173973 A1 9/2003 Wohlrabe
2004/0154650 A1 8/2004 Saito et al.
2006/0011225 A1 1/2006 Saito et al.
2006/0277758 A1 12/2006 Eichhorn et al.

FOREIGN PATENT DOCUMENTS

JP 2004-243113 9/2004
WO 2004/066780 8/2004
WO 2004/089152 10/2004

OTHER PUBLICATIONS

English Language Abstract of JP 2004-243113.

* cited by examiner

*Primary Examiner*—Robert L. DeBeradinis
(74) *Attorney, Agent, or Firm*—Greenblum & Bernstein, P.L.C.

(57) ABSTRACT

An electrical apparatus system includes a depilator (first electrical apparatus) that depilates body hair, a cleaning apparatus (second electrical apparatus) that cleans the depilatory and an AC adapter that supplies DC electric power to the depilator or the cleaning apparatus. Electric power can be supplied between both the electrical apparatuses by bringing a back surface terminal provided in the depilator and a connection terminal provided in the cleaning apparatus into contact with each other.

5 Claims, 5 Drawing Sheets

ELECTRICAL APPARATUS SYSTEM

CROSS REFERENCE TO RELATED APPLICATION

This application is based upon and claims the benefit of priority from prior Japanese Patent Application P2005-207575, filed on Jul. 15, 2005; the entire contents of which are incorporated by reference herein.

BACKGROUND OF THE INVENTION

The present invention relates to an electrical apparatus system including a power generator, a first electrical apparatus and a second electrical apparatus used together with the first electrical apparatus.

As a conventional specific example of an electrical apparatus system including a power generator, a first electrical apparatus and a second electrical apparatus used together with the first electrical apparatus, Japanese Patent Application Laid-open No. 2004-243113 discloses an electrical apparatus system in which a depilator that depilates body hair is used as the first electrical apparatus, a cleaning apparatus that cleans the depilator is used as the second electrical apparatus, and an AC adapter is used as a power generator that supplies electricity to these electrical apparatuses.

As shown in FIG. 1, a depilator 1 is the first electrical apparatus. The depilator 1 includes a control circuit 51 that generally controls the depilator 1, a battery (secondary battery) 52, a side surface terminal 53 that is connected to a cleaning apparatus 2, a charging circuit 54 that charges the battery 52, and a cutting unit 55 that cuts body hair. The cutting unit 55 includes a blade for cutting the body hair, and a motor for rotating the blade.

The cleaning apparatus 2, as the second electrical apparatus, includes a control circuit 61 that controls the entire cleaning apparatus 2, a connection terminal 62 that is connected to the side surface terminal 53 provided in the depilator 1, a cleaning unit 63 that cleans the cutting unit 55, a tightly closed container (not shown) in which cleaning liquid is accommodated, and a pump 64 that supplies the cleaning liquid in the container to the cleaning unit 63 by pressurizing the tightly closed container. The pump 64 pressurizes the cleaning liquid in the cleaning unit 63 after cleaning to send back the same into the container. The cleaning apparatus 2 also includes an air valve 65 for releasing the air-tight state in the container when the cleaning of the depilator 1 using the cleaning liquid is completed and when the cleaning liquid is collected by the pump 64, a fan apparatus 66 that sends air into the cutting unit 55 to dry the same, and a display circuit 68 for displaying states of the depilator 1 and the cleaning apparatus 2 such as the charging state, the cleaning state and the like.

The control circuit 51 of the depilator 1 controls the depilator 1 such that the cutting unit 55 is driven by electric power supplied from an external power supply through an AC adapter or electric power supplied from the battery 52. Control is performed such that the cutting unit 55 of the depilator 1 is driven according to a signal sent from the cleaning apparatus 2 through the connection terminal 62 of the cleaning apparatus 2 and the side surface terminal 53 of the depilator 1. The charging circuit 54 charges the battery 52 by electric power supplied from the external power supply through the AC adapter or electric power supplied from the cleaning apparatus 2 through the connection terminal 62 of the cleaning apparatus 2 and the side surface terminal 53 of the depilator 1. The control circuit 61 of the cleaning apparatus 2 controls operations such as a cleaning operation and a charging operation. The control circuit 61 also controls the sending operations of the control signal and the electric power to the depilator 1 through the connection terminal 62 of the cleaning apparatus 2 and the side surface terminal 53 of the depilator 1. The display circuit 68 includes a display element such as a light-emitting diode, and a drive circuit. The display circuit 68 turns the display element ON or OFF according to a signal from the control circuit 61, the display circuit 68 display the operation state (charging, cleaning or the like) of the depilator 1 and the cleaning apparatus 2.

The power generator (not shown) is an AC adapter that converts AC electric power input from the external power supply into DC electric power of level necessary for operating the depilator 1 and the cleaning apparatus 2. DC electric power is supplied to the depilator 1 and the cleaning apparatus 2 by connecting the external power supply and the depilator 1 or the cleaning apparatus 2 to each other.

The operation of the electrical apparatus system is explained. To remove the body hair, the AC adapter is connected to the depilator 1, and the cutting unit 55 is driven by electric power supplied from the external power supply through the AC adapter. Alternatively, the AC adapter is not connected, and the cutting unit 55 is driven by electric power supplied from the battery 52 incorporated in the depilator 1, thereby removing the body hair. Next, to clean the depilator 1, the external power supply and the cleaning apparatus 2 are connected to each other through the AC adapter, the depilator 1 is reclined against along an inclined portion 67 that rises upward on the one side of the cleaning unit 63 of the cleaning apparatus 2 (right side in FIG. 1) such that a surface on which the side surface terminal 53 is provided and a surface on which the connection terminal 62 is provided are opposed to each other, and the cutting unit 55 is disposed in the cleaning unit 63. If the side surface terminal 53 comes into contact with the connection terminal 62, the contact of the side surface terminal 53 with respect to the connection terminal 62 is detected by any detector, and control is performed such that the cleaning operation is started by the control circuit 61 of the cleaning apparatus 2. Simultaneously, a control signal and electric power are supplied from the cleaning apparatus 2 through the connection terminal 62 and the side surface terminal 53, The control signal sent from the cleaning apparatus 2 through the connection terminal 62 and the side surface terminal 53 is input to the control circuit 51 of the depilator 1 to drive the cutting unit 55. The battery 52 is charged by the electric power supplied from the cleaning apparatus 2 through the connection terminal 62 and the side surface terminal 53.

By sending the control signal and electric power from the cleaning apparatus 2 through the connection terminal 62 and the side surface terminal 53 in this manner, the operation of the cleaning apparatus 2 connected to the external power supply through the AC adapter is controlled, and control of the operation of the depilator 1 and the charging operation can be carried out.

SUMMARY OF THE INVENTION

According to the conventional electrical apparatus system, DC electric power is supplied to the depilator 1 and the cleaning apparatus 2 using the AC adapter, but when the electrical apparatus system has only one AC adapter, in order to clean the depilator 1 after the AC adapter is connected to the depilator 1 and is used, it is necessary to detach the AC adapter from the depilator 1 and is attached to the cleaning apparatus 2, and there is a problem that it is troublesome to switch the AC adapter.

The present invention has been achieved in view of the above problem, and it is an object of the invention to provide an electrical apparatus system in which when an external power supply is connected to one of two electrical apparatuses, electric power can be supplied to the other electrical apparatus to which the external power supply is not connected.

To achieve the above object, the present invention provides an electrical apparatus system including a power generator that produces desired output electric power from input electric power from an external power supply, a first electrical apparatus having a first load to which electric power is supplied from the power generator, and a second electrical apparatus having a second load to which electric power is supplied from the power generator, the second electrical apparatus being used in combination with the first electrical apparatus, wherein the first electrical apparatus includes a first electric power transmitting unit configured to supply the electric power produced by the power generator to the second electrical apparatus and to supply the electric power supplied from the second electrical apparatus to the first load, the second electrical apparatus includes a second electric power transmitting unit configured to supply electric power produced by the power generator to the first electrical apparatus and to supply for supplying electric power supplied from the first electrical apparatus to the second load.

According to this configuration when electric power produced by the power generator is to be supplied to the first electrical apparatus, the electric power can be supplied to the second electrical apparatus through the first electric power transmitting unit, and also when electric power produced by the power generator is to be supplied to the second electrical apparatus, electric power can be supplied to the first electrical apparatus through the second electric power transmitting unit. Therefore, it is possible to supply electric power to both the electrical apparatuses only by connecting the external power supply to one of the electrical apparatuses.

In this invention, the first electrical apparatus can include a secondary battery that supplies electric power to the first load, and a charging unit that charges the secondary battery by the electric power produced by the power generator.

With this configuration, it is possible to store the electric power in the first electrical apparatus, the electrical apparatus system can be utilized without connecting the first electrical apparatus and the external power supply, and the degree of convenience is enhanced.

In this invention, the first electric power transmitting unit can be configured to supply electric power to the second load by the secondary battery.

With this configuration, the second electrical apparatus can be connected to the external power supply, and the degree of convenience is enhanced.

In this invention, the first electrical apparatus can include a constant-voltage circuit that stabilizes battery voltage of the secondary battery to a predetermined constant value.

With this configuration, it is possible to maintain the voltage of the secondary battery constant, and stable electric power can be supplied.

In this invention, the first electrical apparatus can include a constant-voltage circuit control unit that performs control such that the constant-voltage circuit is stopped when a predetermined operation time is elapsed after the time when the constant-voltage circuit starts an operation.

With this configuration, since the control is performed such that the operation is stopped if the given time is elapsed after the constant-voltage circuit starts an operation, deterioration of battery lifetime caused by excessive charging of the secondary battery can be prevented.

DETAILED DESCRIPTION OF THE PREFERRED EMBODIMENTS

Figure 1:
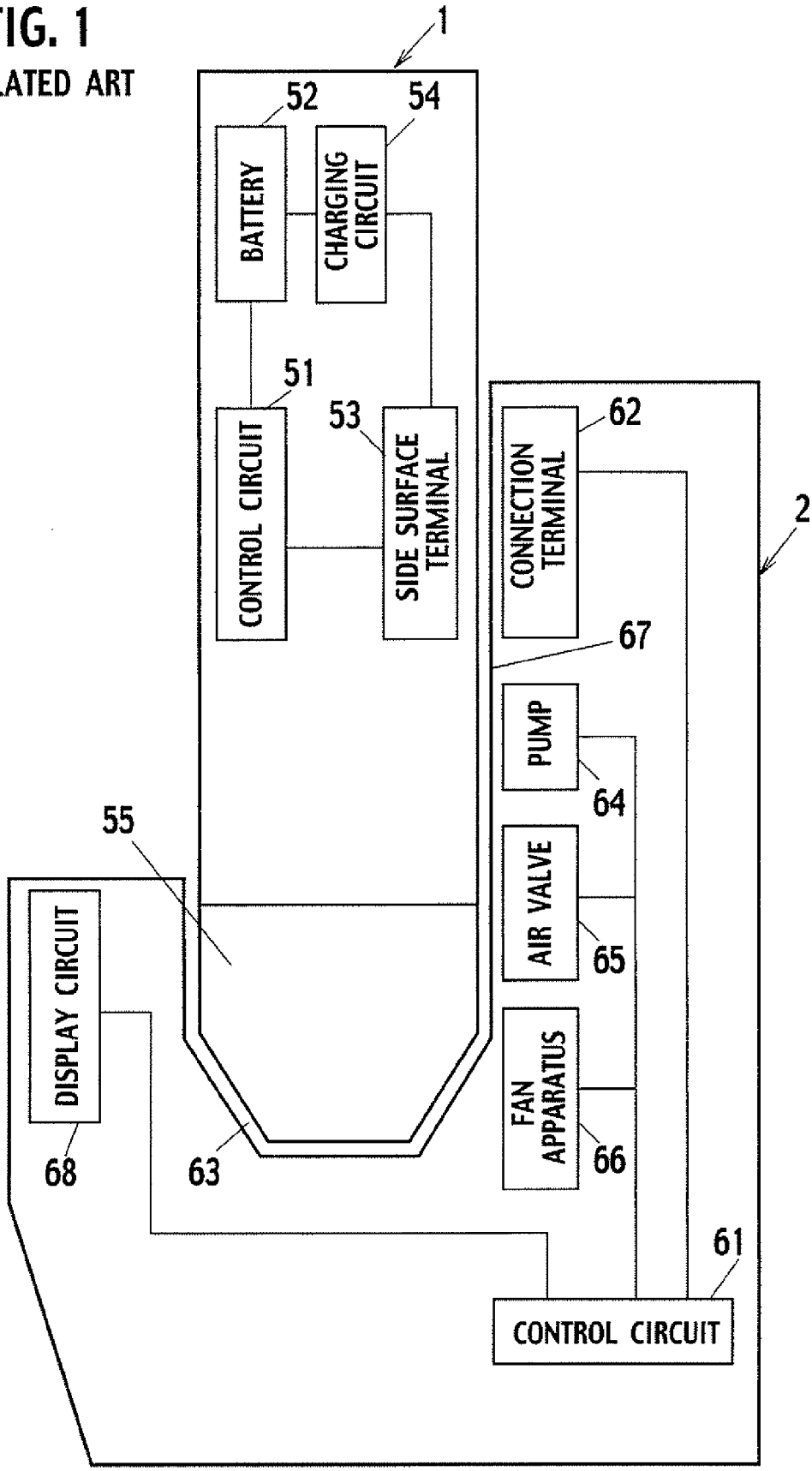
FIG. 1 RELATED ART
FIG. 1 is a schematic view of one example of a conventional electrical apparatus system in which a depilator is used as a first electrical apparatus and a cleaning apparatus is used as a second electrical apparatus.

Embodiments of the present invention will be explained below in detail with reference to the accompanying drawings. Structures and operations of a depilator 1 that is a first electrical apparatus and a cleaning apparatus 2 that is a second electrical apparatus of the present embodiment are the same as those of the conventional depilator 1 and cleaning apparatus 2. Therefore, illustration and explanation of the structures and operations which are not subject matter of the present invention will be omitted. The first electrical apparatus and the second electrical apparatus are not limited to the depilator 1 and the cleaning apparatus 2, and the technical idea of the invention can also be applied to other electrical apparatus systems having electrical apparatuses rather than the depilator 1 and the cleaning apparatus 2.

The electrical apparatus system of the present embodiment includes the depilator 1 as the first electrical apparatus that depilates body hair, and the cleaning apparatus 2 as the second electrical apparatus that cleans the depilator 1, and an AC adapter 3 that supplies DC electric power to the depilator 1 or the cleaning apparatus 2.

The depilator 1 includes a cutting unit 11 as a first load to which electric power is supplied from the AC adapter 3. The depilator 1 also includes a back surface terminal 12 that is a first electric power transmitting unit. The back surface terminal 12 has a function for supplying electric power generated by the AC adapter 3 to the cleaning apparatus 2, and a function for supplying the electric power supplied from the cleaning apparatus 2 to the cutting unit 11. In this embodiment, the depilator 1 includes a secondary battery 13 and a charging circuit 14 as a charging unit for charging the secondary battery 13. The secondary battery 13 can be charged through the charging circuit 14 by the electric power supplied from the AC adapter 3 or electric power supplied from the connection terminal 22.

The cleaning apparatus 2 includes a cleaning unit 24 in which the cutting unit 11 is cleaned, and a cleaning operation unit 21 as a second load to which electric power is supplied from the AC adapter. The cleaning operation unit 21 includes a pump, an air valve and a fan apparatus. The cleaning apparatus 2 also includes a connection terminal 22 as a second electric power transmitting unit. The connection terminal 22 has a function for supplying electric power generated by the AC adapter 3 to the depilator 1, and a function for supplying the electric power supplied from the depilator 1 to the cleaning operation unit 21.

Figure 3A:
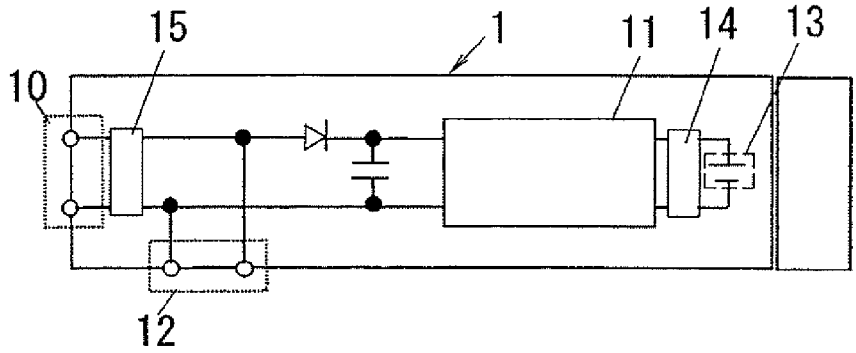
FIG. 3A is a circuit diagram of the depilator of the embodiment of the invention.
Figure 3B:
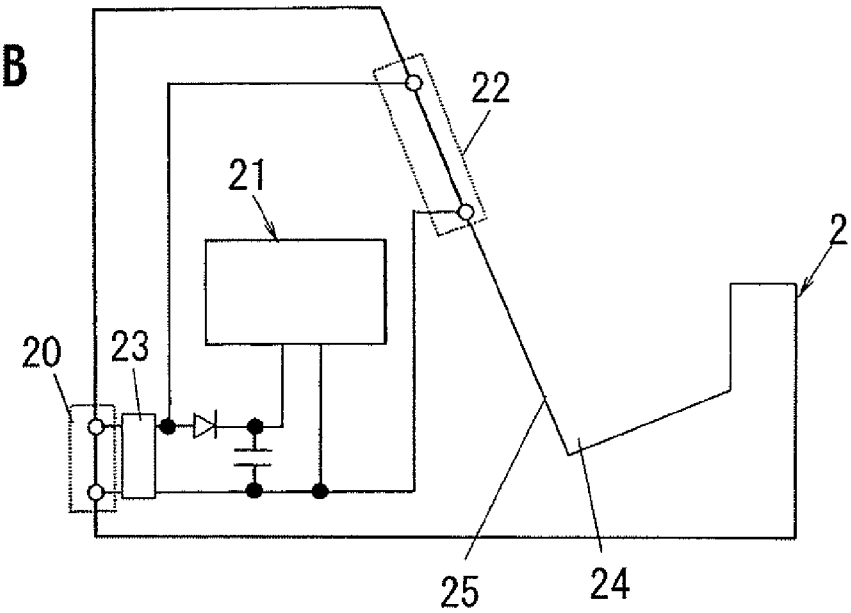
FIG. 3B is a circuit diagram of the cleaning apparatus of the embodiment of the invention.
Figure 3C:
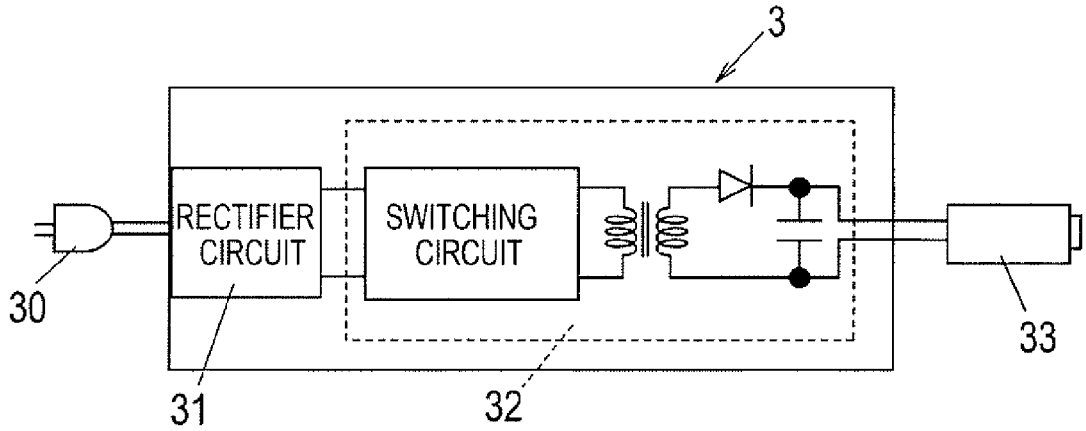
FIG. 3C is a circuit diagram of the AC adapter of the embodiment of the invention.

As shown in FIG. 3C, the AC adapter 3 includes a power supply plug 30 connected to the external power supply, a rectifier circuit 31 that rectifies AC voltage supplied from the external power supply, a switching converter 32 that converts the rectified voltage into a predetermined voltage value, and a device plug 33 connected to the input unit 20 that receives electric power from the external power supply. The device plug 33 is provided in the input unit 10 or the cleaning apparatus 2 that is provided in the depilator 1 and that receives electric power from the external power supply The external power supply and the depilator 1 or the cleaning apparatus 2 are connected to each other through the AC adapter 3. With this configuration, the AC electric power supplied from the external power supply is rectified by the rectifier circuit 31, and the rectified electric power is converted into high frequency by the switching circuit of the switching converter 32. The frequency is lowered by the transformer to a voltage value that is necessary for an operation of the depilator 1 or the cleaning apparatus 2. The voltage is again rectified and smoothened through a diode and a capacitor to produce DC electric power, and the same is supplied to the depilator 1 or the cleaning apparatus 2. Although the switching converter 32 is used as the converter circuit in this embodiment, the converter circuit is not limited to this, and other converter circuit can be constituted.

The cutting unit 11 includes a blade for cutting the body hair, and a motor for rotating the blade. The cutting unit 11 is driven by electric power supplied from the AC adapter 3 or the connection terminal 22. Like the conventional example, the cleaning operation unit 21 includes a pump, an air valve and a fan apparatus. The cleaning operation unit 21 is driven by electric power supplied from the AC adapter 3 or the back surface terminal 12.

Figure 2A:
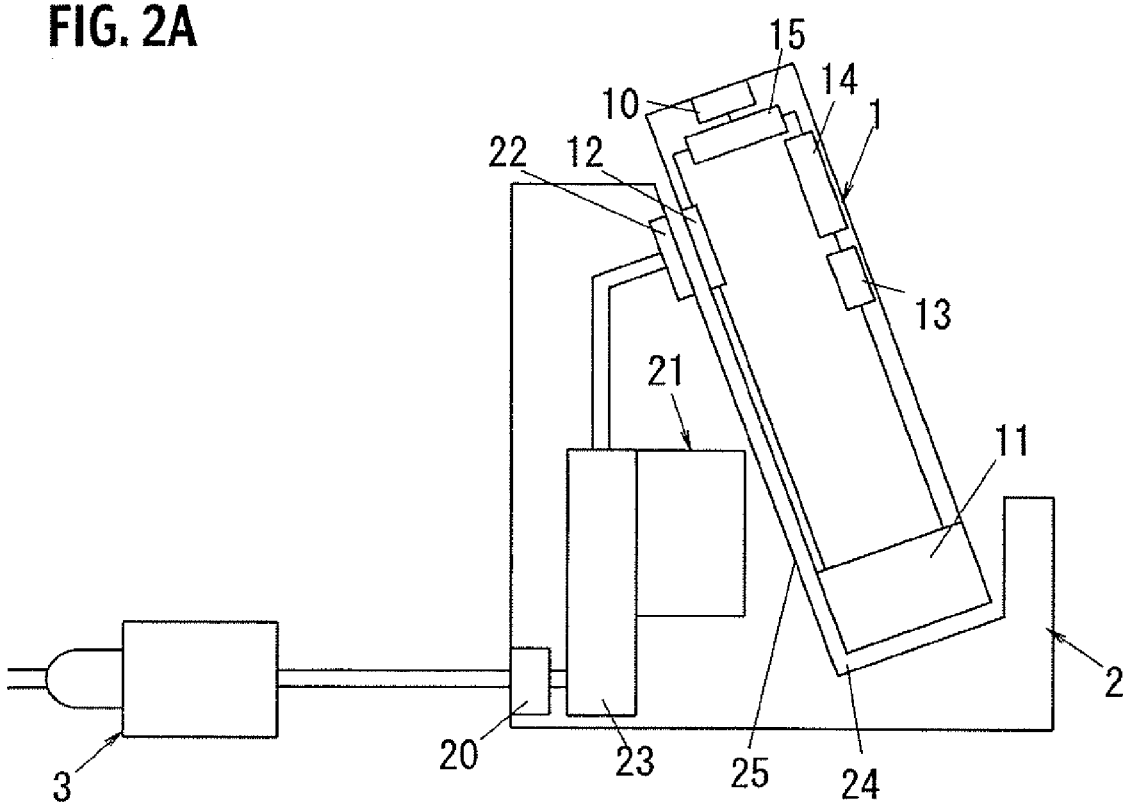
FIG. 2A is a schematic view showing an embodiment of the present invention in which an AC adapter is connected to the cleaning apparatus.

The first electric power transmitting unit is a back surface terminal 12 provided on a back surface (surface opposed to the cleaning apparatus 2 in FIG. 2A) of the depilator 1. The second electric power transmitting unit is a connection terminal 22 provided on a contact surface (surface opposed to the depilator 1 in FIG. 2A) of the cleaning apparatus 2. If the back surface terminal 12 and the connection terminal 22 are brought into contact with each other, they are electrically connected to each other. With this configuration, electric power can be supplied from the depilator 1 to the cleaning apparatus 2, and electric power can be supplied from the cleaning apparatus 2 to the depilator 1.

The operation of the present embodiment is explained below. The depilating method of the body hair is the same as that according to the conventional example. That is, the AC adapter 3 is connected to the depilator 1, and the cutting unit 11 is driven by electric power supplied from the external power supply through the AC adapter 3. Alternatively, the AC adapter 3 may not be connected, and the cutting unit 11 may be driven by electric power supplied from the secondary battery 13. To clean the depilator 1, when the AC adapter 3 is connected to the cleaning apparatus 2 (see FIG. 2A), the depilator 1 is allowed to lean along an inclined portion 25 rising upward from one side (left side in FIG. 2A) of the cleaning unit 24 of the cleaning apparatus 2 such that a surface on which a side surface terminal 22 is provided and a surface on which a connection terminal 12 is provided are opposed to each other, and the cutting unit 11 is disposed on the cleaning unit 24. A control circuit 23 provided in the cleaning apparatus 2 detects contact between the back surface terminal 12 and the connection terminal 22. Electric power produced by the AC adapter 3 is supplied to the cleaning operation unit 21 to drive the cleaning operation unit 21. Control is performed such that the cutting unit 11 of the depilator 1 is cleaned. At the same time, electric power is supplied to the cutting unit 11 of the depilator 1 through the connection terminal 22 and the back surface terminal 12 to drive the cutting unit 11. The secondary battery 13 is charged through the charging circuit 14. In this embodiment, control is performed such that if the depilator 1 is set on the cleaning apparatus 2, the cleaning operation unit 21 and the cutting unit 11 are automatically driven and the secondary battery 13 is automatically charged. Alternatively, control can be performed such that the depilator 1 is disposed at a predetermined position of the cleaning apparatus 2, the back surface terminal 12 and the connection terminal 22 is brought into contact with each other and then, a switch (not shown) provided on the cleaning apparatus 2 is operated, and the cleaning operation unit 21 and the cutting unit 11 are driven and the secondary battery 13 can be charged.

Figure 2B:
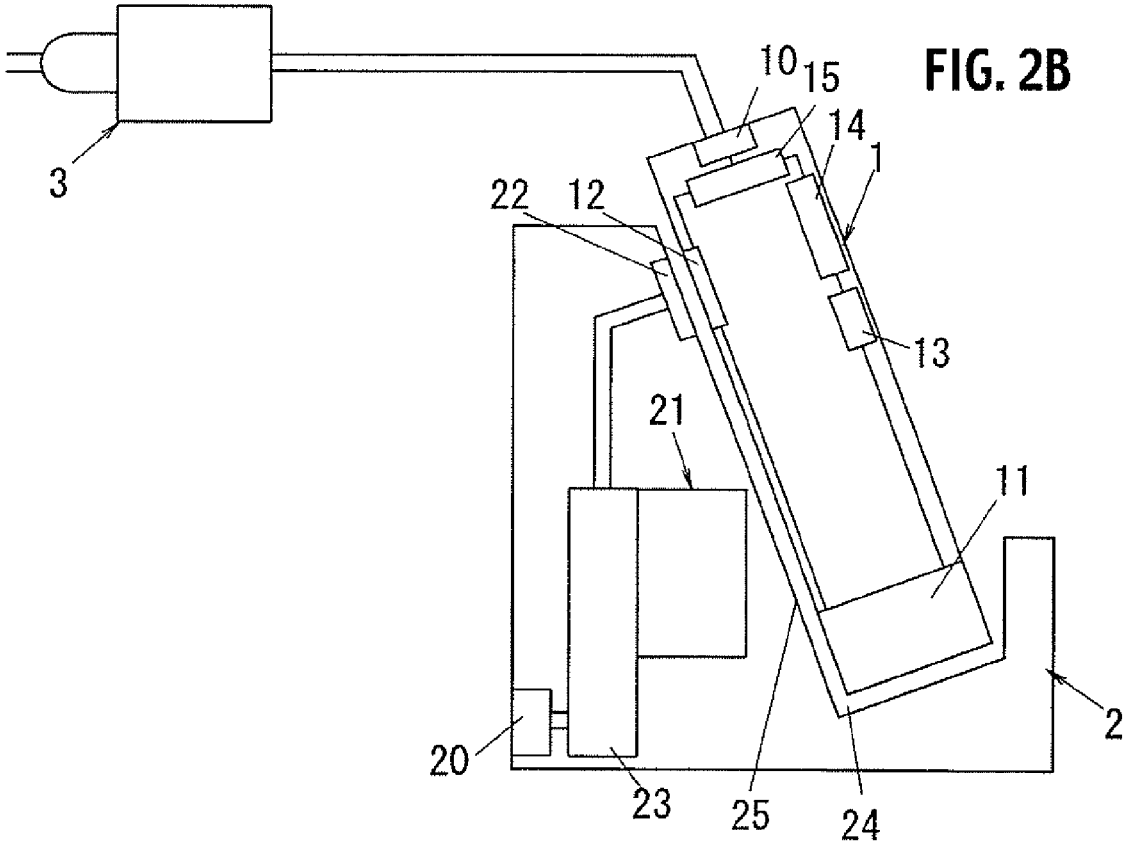
FIG. 2B is a schematic view showing an embodiment of the present invention in which the AC adapter is connected to the depilator.

When the AC adapter 3 is connected to the depilator 1 (see FIG. 2B), the depilator 1 is allowed to lean along the inclined portion 25 such that the surface on which the side surface terminal 22 is provided and the surface on which the connection terminal 12 is provided are opposed to each other, and if the cutting unit 11 is disposed in the cleaning unit 24, a control circuit 15 of the depilator 1 detects the contact between the back surface terminal 12 and the connection terminal 22, electric power produced by the AC adapter 3 is supplied to the cutting unit 11 to drive the cutting unit 11, and the secondary battery 13 is charged through the charging circuit 14. At the same time, electric power is supplied to the cleaning operation unit 21 of the cleaning apparatus 2 through the back surface terminal 12 and the connection terminal 22 to drive the cleaning operation unit 21, and the cutting unit 11 of the depilator 1 is cleaned Like the case where the AC adapter 3 is connected to the cleaning apparatus 2, control may not be performed such that if the depilator 1 is disposed in the cleaning apparatus 2, the cleaning operation unit 21 and the cutting unit 11 are driven and the secondary battery 13 is charged, but control may be performed such that if the switch (not shown) provided on the depilator 1 is operated, the cleaning operation unit 21 and the cutting unit 11 are driven and the secondary battery 13 is charged.

When the AC adapter 3 is not connected to any of the electrical apparatuses, the depilator 1 is allowed to lean along the inclined portion 25 such that the surface on which the side surface terminal 22 is provided and the surface on which the connection terminal 12 is provided are opposed to each other, and if the cutting unit 11 is disposed in the cleaning unit 24, a control circuit 15 of the depilator 1 detects the contact between the back surface terminal 12 and the connection terminal 22, electric power is supplied from the secondary battery 13 to the cutting unit 11 to drive the cutting unit 11. At the same time, electric power is supplied to the cleaning operation unit 21 of the cleaning apparatus 2 through the back surface terminal 12 and the connection terminal 22, the cleaning operation unit 21 is driven and the cutting unit 11 of the depilator 1 is cleaned. In this case also, like the case where the AC adapter 3 is connected to the depilator 1, control can be performed such that if the switch (not shown) provided on the depilator 1 is operated, the cleaning operation unit 21 and the cutting unit 11 are driven.

According to the present embodiment, both the depilator 1 and the cleaning apparatus 2 are provided with the electric power transmitting units. Thus, no matter whether the AC adapter 3 is connected to depilator 1 or the cleaning apparatus 2, electric power can be supplied to both the depilator 1 and the cleaning apparatus 2. Therefore, if the AC adapter 3 is connected to one of the electrical apparatuses, it is unnecessary to switch the AC adapter 3, and the degree of convenience is enhanced. Even when the AC adapter 3 is not connected to any of the electrical apparatuses, the cleaning operation unit 21 and the cutting unit 11 can be driven by the secondary battery 13 of the depilator 1, and the degree of convenience is enhanced.

Figure 4:
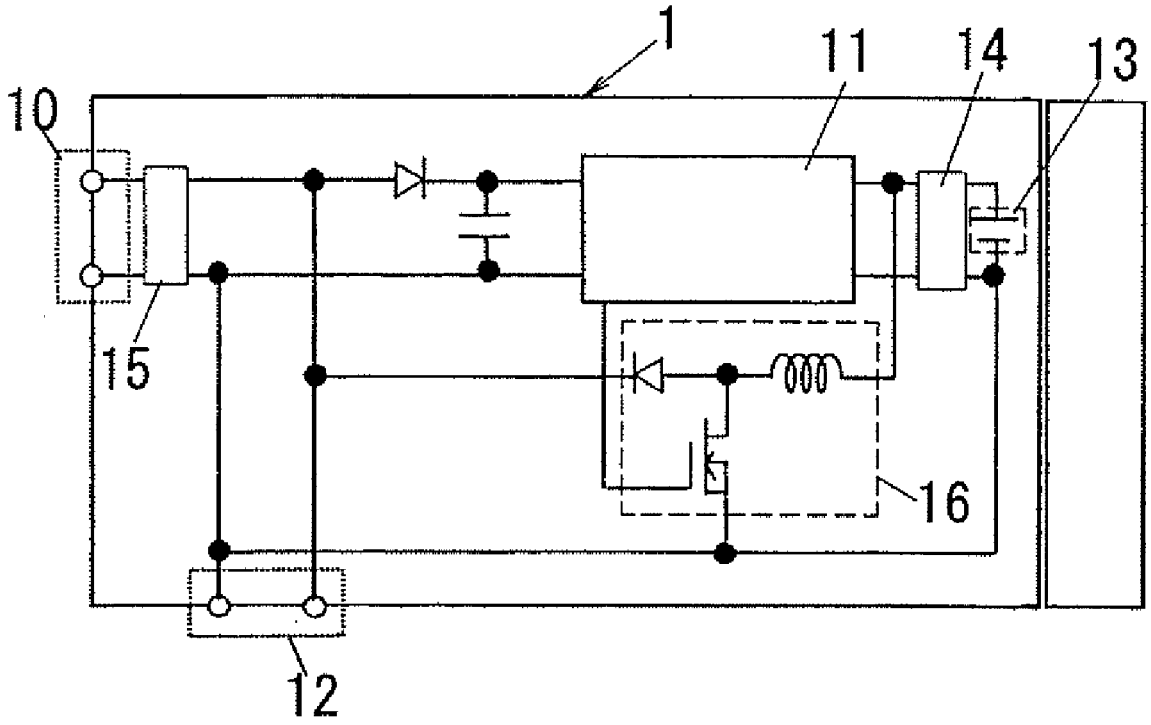
FIG. 4 is a circuit diagram of the embodiment of the invention having a constant-voltage circuit.

The electrical apparatus can includes a constant-voltage circuit 16 that increases the output voltage from the secondary battery 13, keeps the voltage constant and sends the same to the back surface terminal 12 (see FIG. 4). The constant-voltage circuit 16 includes a conventionally known step-up converter including an inductor, an FET and a diode. The constant-voltage circuit 16 makes the output voltage of the secondary battery 13 constant by PWM controlling the on duty ratio of the FET, and can supply stable electric power to the cleaning apparatus 2. The circuit structure of the constant-voltage circuit 16 is not limited to the above-described structure. The control circuit 15 can perform control such that when a predetermined operation time is elapsed from the time when the constant-voltage circuit 16 starts an operation, the constant-voltage circuit 16 is stopped. By limiting the operation time of the constant-voltage circuit 16, deterioration of battery lifetime caused by excessive charging of the secondary battery 13 can be prevented. In this case, the control circuit 15 is the constant-voltage control unit.

Figure 5A:
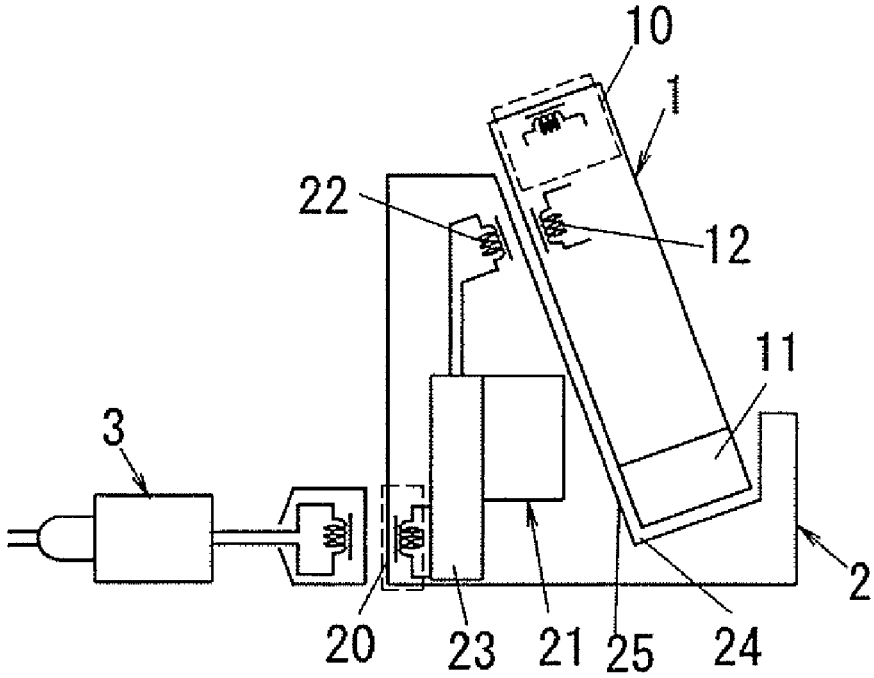
FIG. 5A is a schematic view of the embodiment of the invention in which a terminal connected to an outside includes a transformer and the AC adapter is connected to the second electrical apparatus.
Figure 5B:
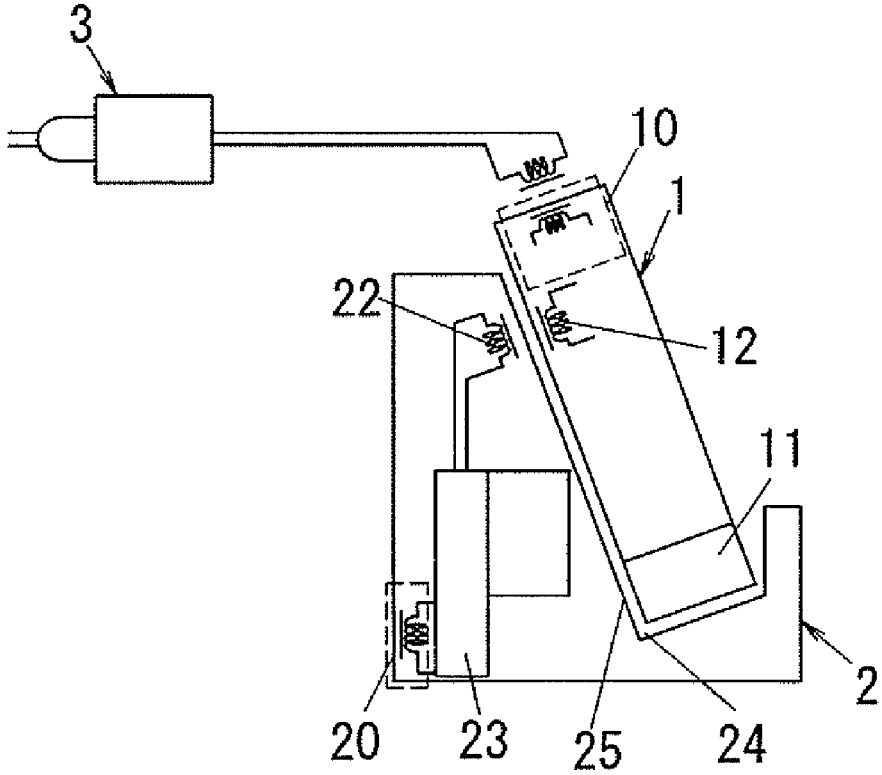
FIG. 5B is a schematic view of the embodiment of the invention in which a terminal connected to an outside includes a transformer and the AC adapter is connected to the first electrical apparatus.

In the present embodiment, to supply electric power between the depilator 1 and the cleaning apparatus 2, the back surface terminal 12 and the connection terminal 22 are brought into contact with each other. Alternatively, the device plug 33 of the AC adapter 3 and the input unit 10 of the depilator 1 can include coils, and the input unit 20 of the cleaning apparatus 2, the back surface terminal 12 and the connection terminal 22 can include coils, and the electric power can be supplied in a non-contact manner utilizing electromagnetic induction between the coils (see FIG. 5). More specifically, the device plug 33 of the AC adapter 3, the input unit 10 of the depilator 1, the input unit 20 of the cleaning apparatus 2, the back surface terminal 12 and the connection terminal 22 are respectively provided with coils. With this configuration, the device plug 33 and the input unit 10 of the depilator 1, or the input unit 20 of the cleaning apparatus 2 are electromagnetically connected with each other, and the back surface terminal 12 and the connection terminal 22 are electromagnetically connected with each other. In this case, since electrodes (the back surface terminal 12 and the connection terminal 22) are not exposed from surfaces of the depilator 1 and the cleaning apparatus 2, it is possible to prevent water from entering the depilator 1 and the cleaning apparatus 2.

While the embodiment of the present invention has been described above, the invention is not limited to the above embodiment and changes and modifications can be made within the scope of the gist of the present invention.

What is claimed is:

1. An electrical apparatus system comprising a power generator that produces a desired output electric power from an input electric power from an external power supply, a first electrical apparatus having a first load to which electric power is supplied from the power generator, and a second electrical apparatus having a second load to which electric power is supplied from the power generator, the second electrical apparatus being used in combination with the first electrical apparatus, wherein the first electrical apparatus includes a first electric power transmitting unit configured to supply the electric power produced by the power generator to the second electrical apparatus and to supply the electric power supplied from the second electrical apparatus to the first load, the second electrical apparatus including a second electric power transmitting unit configured to supply electric power produced by the power generator to the first electrical apparatus and to supply electric power supplied from the first electrical apparatus to the second load.

2. The electrical apparatus system of claim 1, wherein the first electrical apparatus includes a secondary battery that supplies electric power to the first load, and a charging unit that charges the secondary battery by the electric power produced by the power generator.

3. The electrical apparatus system of claim 2, wherein the first electric power transmitting unit is configured to supply electric power to the second load by the secondary battery.

4. The electrical apparatus system of claim 3, wherein the first electrical apparatus includes a constant-voltage circuit that stabilizes battery voltage of the secondary battery to a predetermined constant value.

5. The electrical apparatus system of claim 4, wherein the first electrical apparatus includes a constant-voltage circuit control unit that performs control such that the constant-voltage circuit is stopped when a predetermined operation time is elapsed after a time when the constant-voltage circuit starts an operation.

* * * * *

UNITED STATES PATENT AND TRADEMARK OFFICE

CERTIFICATE OF CORRECTION

PATENT NO. : 7,521,820 B2
APPLICATION NO. : 11/456959
DATED : April 21, 2009
INVENTOR(S) : Hiroyasu Kitamura It is certified that error appears in the above-identified patent and that said Letters Patent is hereby corrected as shown below:

On the Title Page, item [57]: under Abstract (line 3), "depilatory" should be --depilator--.

Signed and Sealed this

Seventeenth Day of November, 2009

David J. Kappos

David J. Kappos
*Director of the United States Patent and Trademark Office*